US008793852B2

(12) United States Patent
Garrett et al.

(10) Patent No.: US 8,793,852 B2
(45) Date of Patent: Aug. 5, 2014

(54) SHAFT ALIGNMENT HAND TOOL

(75) Inventors: William A. Garrett, Taylors, SC (US); James A. Garrett, Jr., Easley, SC (US)

(73) Assignee: William A. Garrett

( * ) Notice: Subject to any disclaimer, the term of this patent is extended or adjusted under 35 U.S.C. 154(b) by 82 days.

(21) Appl. No.: 12/870,791

(22) Filed: Aug. 28, 2010

(65) Prior Publication Data

US 2012/0047702 A1 Mar. 1, 2012

(51) Int. Cl.
*B25B 11/00* (2006.01)

(52) U.S. Cl.
USPC ..... 29/271; 269/1; 269/271

(58) Field of Classification Search
USPC ..... 269/261, 262, 266, 271, 313, 314, 319, 269/43, 45, 71; 29/271
See application file for complete search history.

(56) References Cited

U.S. PATENT DOCUMENTS 824,394 A * 6/1906 Warner ..... 269/137
1,066,357 A * 7/1913 Yardley ..... 269/188
4,186,916 A * 2/1980 Varga ..... 269/303
4,221,391 A * 9/1980 Dutton ..... 279/123
4,796,900 A * 1/1989 Gant et al. ..... 279/123
5,056,766 A * 10/1991 Engibarov ..... 269/136
5,069,647 A * 12/1991 Zuviria ..... 446/127
5,984,291 A * 11/1999 Iwata et al. ..... 269/73
6,641,126 B2 * 11/2003 Yang ..... 269/282
7,344,310 B2 * 3/2008 Mine ..... 384/49

FOREIGN PATENT DOCUMENTS

JP 2003028259 A * 1/2003

OTHER PUBLICATIONS

JP2003-028529—Machine translation—provided by JPO Database.*

* cited by examiner

*Primary Examiner* — Lee D Wilson
*Assistant Examiner* — Tyrone V Hall, Jr.

(57) ABSTRACT

A shaft alignment hand tool for aligning a shaft is intended to align a shaft to a mating shaft. The shaft alignment hand tool has a U-shaped elongated body member comprising ten sides, a slotted void and further comprises three aligned tapped holes located on a top outer side surface for locking the alignment tool to a support surface and one tapped through hole located on a front bottom outside side surface for aligning the shafts.

5 Claims, 6 Drawing Sheets

SHAFT ALIGNMENT HAND TOOL

FIELD OF THE INVENTION

This invention relates to hand tools, and particularly to rotating machinery shaft alignment hand tool.

BACKGOUND OF THE INVENTION

Difficulty of aligning a rotating machinery, motor, gearbox, pump shaft to a mating shaft is well known to the industry. A prior art shaft alignment tool 17, 18, 19 is described herein and illustrated in FIGS. 8 to 14. The rotating machinery mounting bolts 13, 14, 15, and 16 are to be loosened. The prior art hand tool eccentric hex socket 17 is fitted over hex head bolt 14, alignment tool housing 18 is fitted over the eccentric hex socket 17, the opposite end of the alignment tool, thumb wheel adjusting end is placed against the edge of the motor plate 20, the thumb wheel nut 19 is rotated clockwise screwing to pull the tool 18 against the motor plate edge 20. Once the tool is slugged to plate 20 the eccentric hex socket 17 is rotated about the hex head bolt 14 inside of the tool housing 18. The mounting hex head bolt 14 acts as a stationary point and the eccentric hex socket rotating inside the tool housing 18 moves the motor plate for shaft alignment.

The prior shaft alignment tool is not effective when there are slots in both the rotating machinery base plate 7, not shown, and slots in the motor plate 20 as shown in FIG. 14 slots 21, 22, 23, and 24. The prior shaft alignment tool is only effective when hex head mounting bolts 13, 14, 15, 16 are used when mounting rotating machinery. The prior shaft alignment tool could create stress and thread distortion by using bolt 14 as a stationary pulling point.

Being that there are varies rotating machinery, motors, gearboxes and pump sizes, the prior art shaft alignment tool requires a person to carry a multiple tool kit and many wrench sizes for motor shaft alignment.

A second alternative in an ideal situation and in skilled hands with experience a worker one could loosen the rotating machinery, motor, gearbox or pump base plate securing bolts, pry with a bar and tap with a hammer to align the rotating machinery, motor, gearbox, or pump. However, this method could damage the rotating machinery, motor, gearbox or pump and requires a lot of time to align the rotating machinery, motor, gearbox or pump to the mating shaft because the movement of the rotating machinery, motor, gearbox or pump cannot be controlled precisely to the manufactures specifications.

The real problem in the industrial is that most skilled persons performing rotating machinery, motor, gearbox or pump shaft alignments to a mating shaft do not have a single hand alignment tool that will fit multiple rotating machinery, motor, gearbox or pump sizes and in addition is easy to use. Such extra manipulations using multiple hand tools are very time consuming and detract from the usefulness of the prior art shaft alignment tool.

There is therefore a need for a rotating machinery, motor, gearbox or pump shaft alignment hand tool and method which will allow a person to conveniently align various sizes of rotating machinery, motor, gearbox or pump shaft to a mating shaft without using multiple hand tools, in addition an easy installation of the shaft alignment hand tool to the rotating machinery, motor, gearbox or pump base plate. The present invention is directed toward meeting this need.

SUMMARY OF THE INVENTION

A shaft alignment hand tool is disclosed which includes a substantially elongated body member having ten flat sides.

Two short flat sides and eight longer flat sides. A slotted void cut into the longer side of the elongated body member running parallel the entire length of the elongated body member. The slotted void width is oversized to fit varies plate thicknesses. The flat side parallel to the slot of the elongated body member has three aligned tapped holes protruding through the first wall into the slotted void. These tapped holes are perpendicular to the slot. Three screws are threaded into the threaded holes. The side that incorporates the slotted void, and surface that forms the slot outer wall opposite from the first outer wall that the three aligned tapped holes are threaded into has one tapped hole through the elongated body member; one screw is threaded into the hole.

Using of the shaft hand alignment tool is described as follows, the slot of the shaft alignment hand tool is positioned against the edge of the rotating machinery, motor, gearbox or pump base plate, straddling the base plate, the three screws on the bottom of the shaft alignment hand tool are tighten to lock the shaft alignment hand tool to the rotating machinery, motor, gearbox or pump mounting plate. Loosening of the rotating machinery, motor, gearbox or pump mounting plate securing bolts to allow the rotating machinery, motor, gearbox or pump to move, the single screw perpendicular to the three aligned screws of the shaft alignment hand tool is rotated clockwise until the end of the screw is against the rotating machinery, motor, gearbox or pump mounting base plate, additional rotating of the screw will precisely move the rotating machinery, motor, gearbox or pump for shaft alignment.

DETAILED DESCRIPTION OF THE PRESENT INVENTION

In order for those skilled in the art can further understand the principles of the present invention, a description will be described in the following details. However, these descriptions and appended drawings described are for those skilled in the art to which the invention relates.

Referring to FIGS. 1 to 7, the shaft alignment hand tool of the present invention is illustrated. The shaft alignment hand tool has the following elements.

FIGS. 1 to 5 A Shaft Alignment hand tool 1 illustrates an elongated body member of the invention. The elongated body member 1 is shaped with ten flat sides having eight long flat sides and two short flat sides. A slotted void having three flat sides 1*a*, 1*b*, 1*c* cut into the elongated body member parallel to the longer length of the elongated body member from end to end. One flat side of the elongated body member 1[*d*] has three aligned tapped holes that penetrate only through the first wall of the slotted void. Three screws 2, 3, and 4 are threaded into the three aligned tapped holes. The flat side of the elongated body member 1[*e*] that incorporates the slotted void, and surface that forms the slot outer wall opposite from the first outer slot wall that the three aligned tapped holes are formed into of the elongated body member has one tapped hole through the elongated body member. A screw 6 is threaded into the threaded hole of the elongated body member.

Figure 1:
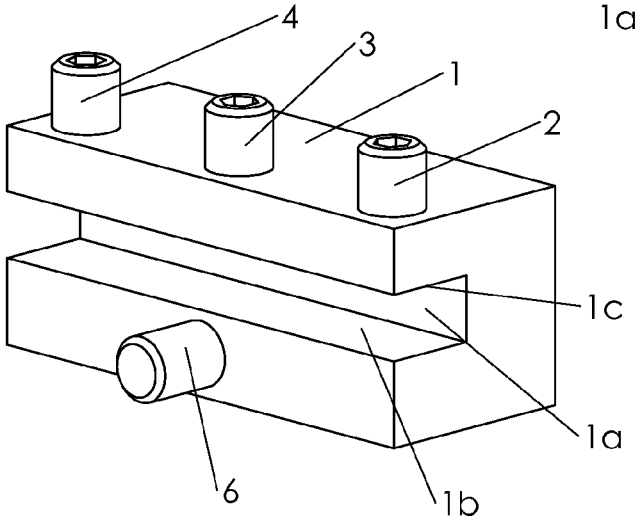
FIG. 1 is a perspective view of the shaft alignment hand tool of the present invention.
Figure 2:
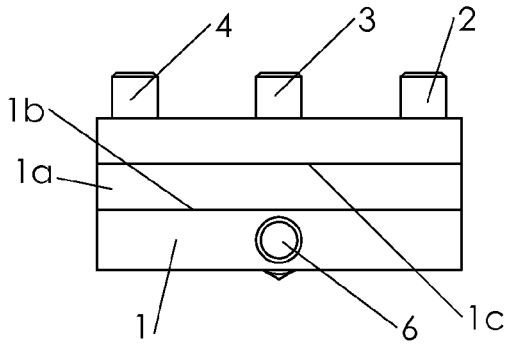
FIG. 2 is a front plan view of the shaft alignment hand tool of the present invention.
Figure 3:
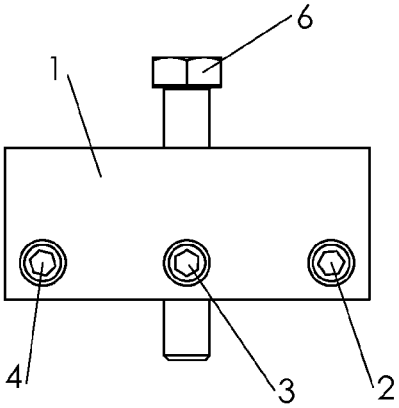
FIG. 3 is a top plan view of the shaft alignment hand tool of the present invention.
Figure 5:
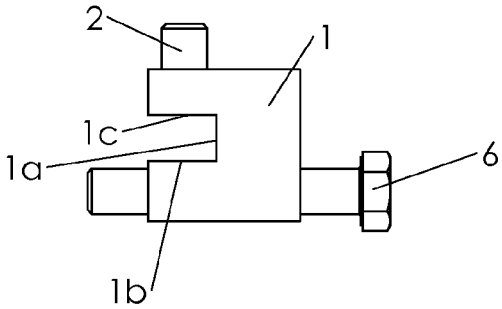
FIG. 5 is a right side plan view of the shaft alignment hand tool of the present invention.
Figure 4:
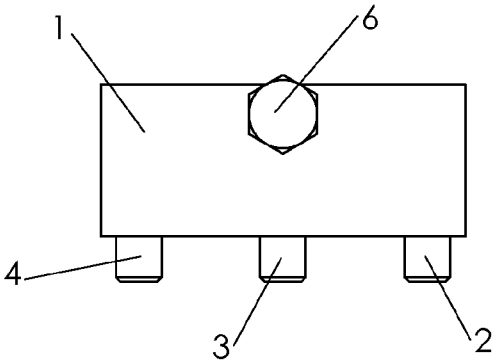
FIG. 4 is a rear plan view of the shaft alignment hand tool of the present invention.
Figure 6:
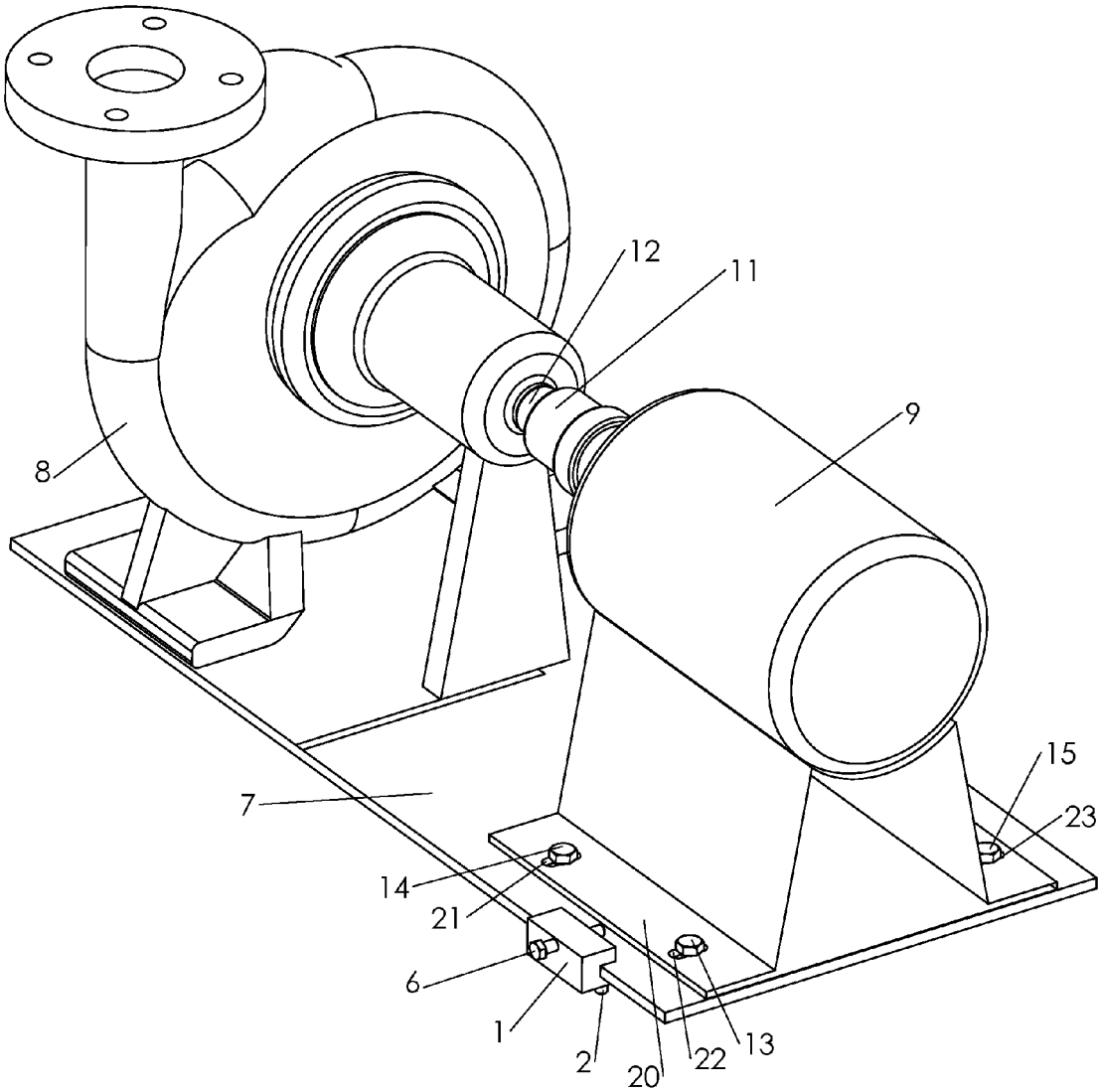
FIG. 6 is a perspective view of the shaft alignment hand tool of the present invention mounted to the rotating machinery.
Figure 7:
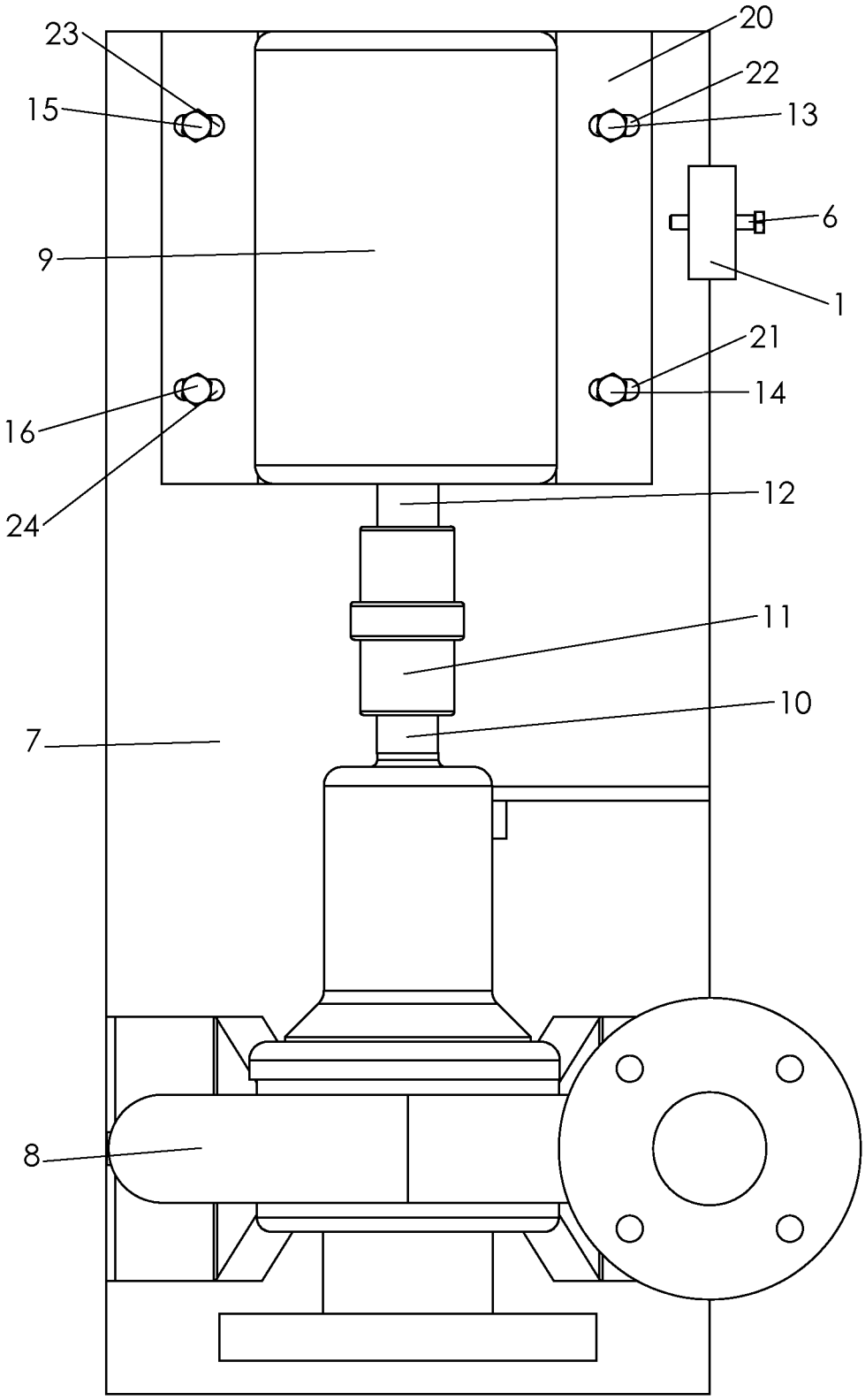
FIG. 7 is a top plan view of the shaft alignment hand tool of the present invention mounted to the rotating machinery base plate.
Figure 8:
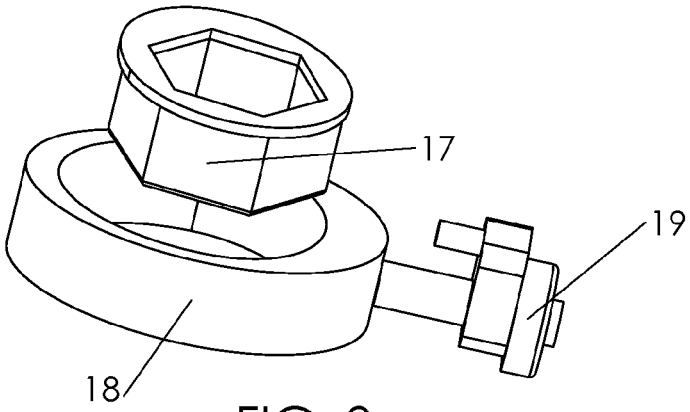
FIG. 8 is a perspective view of a prior art shaft alignment hand tool.
Figure 11:
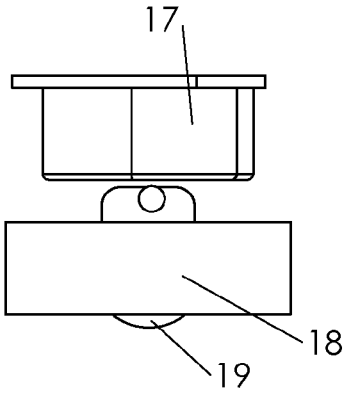
FIG. 11 is a left side view of a prior art shaft alignment hand tool.
Figure 9:
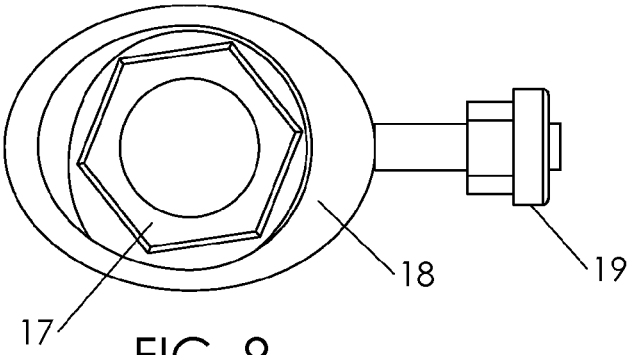
FIG. 9 is a top plan view of a prior art shaft alignment hand tool.
Figure 10:
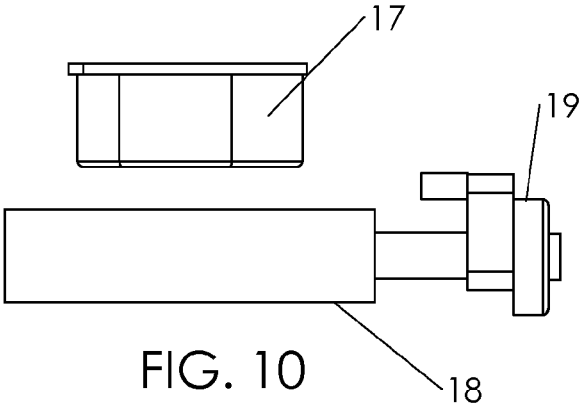
FIG. 10 is a front view of a prior art shaft alignment hand tool.
Figure 12:
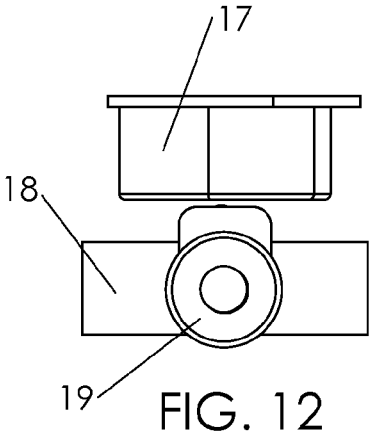
FIG. 12 is a right view of a prior art shaft alignment hand tool.
Figure 13:
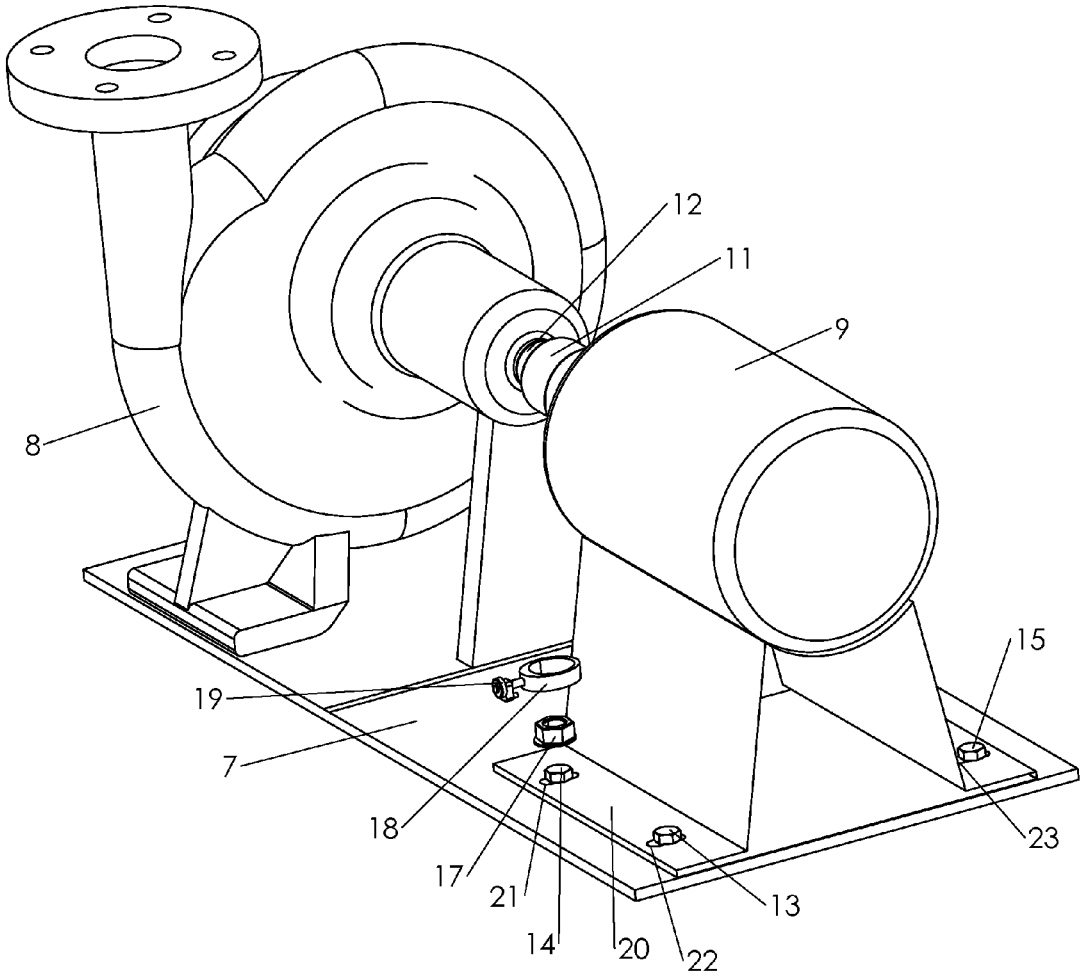
FIG. 13 is a perspective view with a partial exploded view of a prior art shaft alignment hand tool mounted to the rotating machinery base plate.
Figure 14:
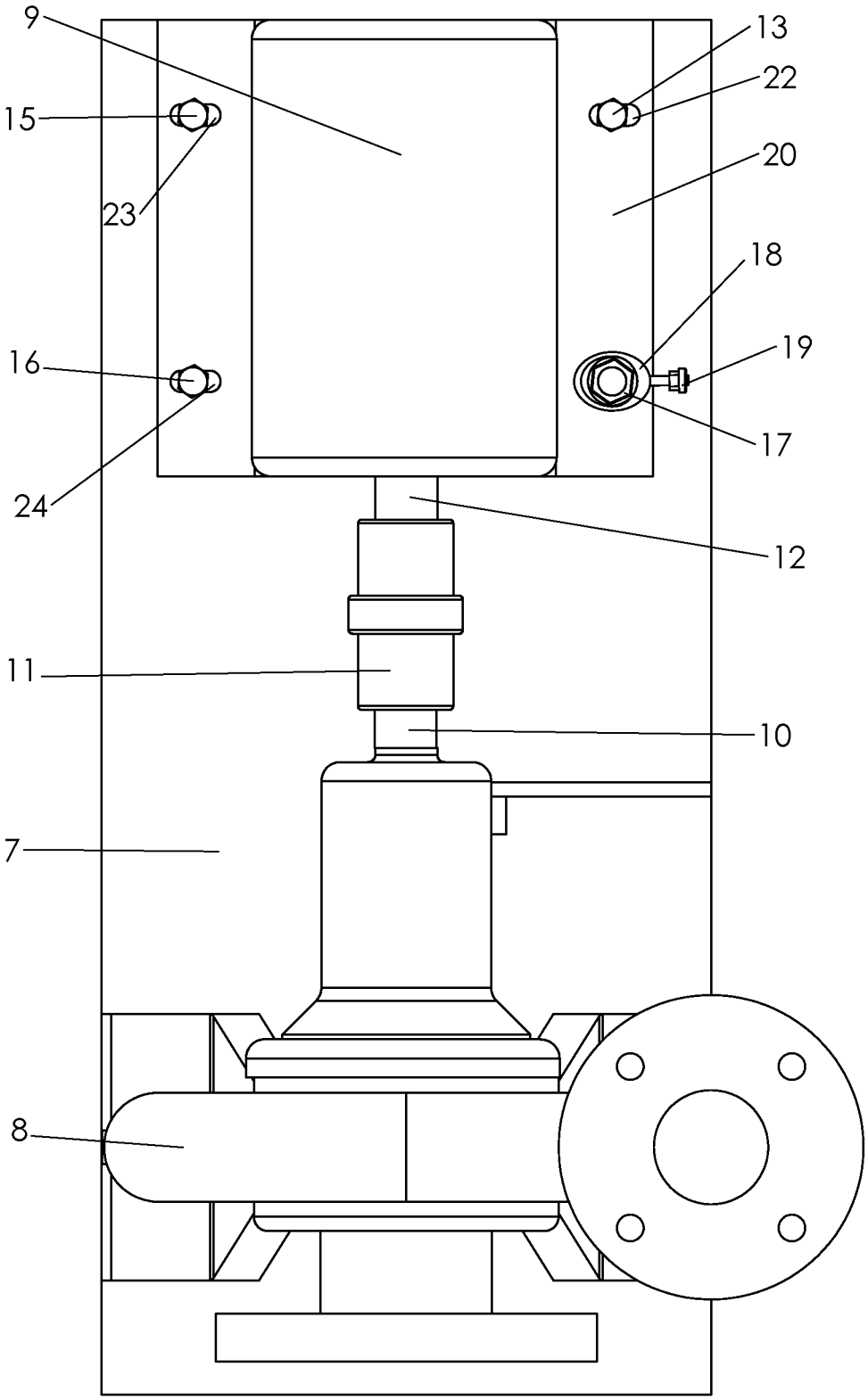
FIG. 14 is a top plan view of a prior art shaft alignment hand tool mounted to the rotating machinery base plate.

Referring to FIGS. 6 and 7 illustrates and describes the use of the shaft alignment hand tool. Generally rotating machinery that require a separate power source to power the mating rotating machinery is coupled to a power drive having two rotating shafts 10 and 12 with a coupling 11 connecting the two shafts 10 and 12 together. One of the rotating machinery 8 is mounted stationary while the other rotating machinery 9 is mounted in such it can be moved freely from left to right. The two shafts 10 and 12 are aligned to each other by aligning only one shaft. In FIGS. 7 and 14, shaft 12 is the aligning shaft. The coupling will compensate for a degree of misalignment specified by the manufactures specifications. The shaft alignment hand tool 1 provides the necessary needs in order to align two shafts.

The shaft alignment hand tool is positioned onto a rotating machinery, motor, gearbox or pump 8 and 9, base plate 7 with the slot 1*a* straddling the base plate 7, butted up against the base plate 7 until the motor shaft alignment tool stops at the back of the slotted void 1*a*. Three screws 2, 3, 4 are tighten against the base plate 7 pulling the bottom surface of the slotted void 1*b* down against the motor base plate 7, and forcing the screws 2,3,4 to penetrate the under surface of the motor base plate 7 to secure the shaft alignment hand tool 1 to the base plate 7. Rotating machinery, motor, gearbox or pump motor mounting bolts 13, 14, 15, and 16 are loosen so base plate 20 can slide freely. Slots 21, 22, 23, 24 will allow base plate 20 to slide freely beneath the mounting bolts 13, 14, 15, 16. Rotating machinery shafts 10 and 12 are coupled with coupling 11. The shaft alignment will be performed only on one shaft 10. Shaft 10 will be aligned to shaft 12. Shaft alignment hand tool screw 6 is rotated clockwise until the bolt end makes contact to motor plate 20, additional rotation will push the motor plate 20 to a desirable position for shaft alignment. The shaft alignment hand tool FIG. 1 can be used in multiples so removal of the hand tool is not necessary to align the opposite side of the shaft.

What is claimed is:

1. A shaft alignment hand tool comprising:

a U-shaped elongated body member comprising: ten sides and a slotted void, and further comprising:

three aligned tapped holes located on a top outer side surface; and one tapped through hole located on a front bottom outer side surface and perpendicular to said three aligned tapped holes.

2. The shaft alignment hand tool as claimed in claim 1, wherein the three aligned tapped holes extend through the top outer side surface into the slotted void, wherein:

the first tapped hole is respectively spaced apart from the second and third tapped holes, and the second tapped hole is respectively spaced apart from the first and third tapped holes.

3. The shaft alignment hand tool as claimed in claim 1, wherein the three aligned tapped holes further comprise a respective threaded hole and one screw threadably engaged into said threaded hole.

4. The shaft alignment hand tool as claimed in claim 1, wherein the one tapped through hole extends from the front bottom outer side surface and through a rear outer side surface.

5. The shaft alignment tool as claimed in claim 1, wherein the one tapped through hole further comprises a respective threaded hole and one screw threadably engaged into said threaded hole.

* * * * *